United States Patent [19]

Spears

[11] Patent Number: 4,848,454

[45] Date of Patent: Jul. 18, 1989

[54] DOWNHOLE TOOL FOR USE WITH A BALL AND SEAT TRAVELING VALVE FOR A FLUID PUMP

[76] Inventor: Harry L. Spears, 6307 Glenhill, Spring, Tex. 77379

[21] Appl. No.: 127,189

[22] Filed: Dec. 1, 1987

[51] Int. Cl.[4] ..... E21B 34/06; F04B 39/08

[52] U.S. Cl. ..... 166/108; 166/165; 166/328; 175/299; 417/554

[58] Field of Search ..... 166/68, 68.5, 105, 107, 166/108, 165, 167, 325, 327, 328, 329, 369, 372; 175/299; 251/76; 417/554

[56] References Cited

U.S. PATENT DOCUMENTS

| | | | |
|---|---|---|---|
| 1,615,921 | 2/1927 | Thompson | 175/299 |
| 1,832,323 | 11/1931 | Rigby | 166/108 |
| 2,214,551 | 9/1940 | Edwards | 166/165 |
| 2,256,567 | 9/1941 | Moseley | 166/105 |
| 2,394,189 | 2/1946 | Kaufman | 166/369 |
| 3,021,794 | 2/1962 | Knox | 417/554 |
| 3,367,279 | 2/1968 | Crowe | 417/554 |

*Primary Examiner*—Jerome W. Massie
*Assistant Examiner*—Terry Lee Melius
*Attorney, Agent, or Firm*—Ben D. Tobor

[57] ABSTRACT

A downhole tool for use with a ball and seat travelling valve associated with a moveable plunger includes a means for causing relative movement between the upper and lower housings forming the downhole tool, whereby a bumping force may be imparted to the plunger to unseat the ball during the downstroke of the downhole tool.

7 Claims, 2 Drawing Sheets

DOWNHOLE TOOL FOR USE WITH A BALL AND SEAT TRAVELING VALVE FOR A FLUID PUMP

1. Field of the Invention

The invention relates to a downhole tool for use with a ball and seat travelling valve of a fluid pump for elevating fluids, and in particular, for a travelling valve for a fluid pump for raising petroleum fluids through production tubing in completed oil wells.

2. Description of the Prior Art

A conventional oil well includes a cased well bore with one or more strings of tubing extending downwardly through the casing into the oil or other petroleum fluid contained in the sub-surface mineral formation to be produced. The casing is perforated at the level of the production zone to permit fluid flow from the formation into the casing, and the lower end of the tubing string is generally open to provide entry for the fluid into the tubing.

One type of pump conventionally employed in structures of the type described is wedged into an internal constriction or seating nipple formed internally of the tubing below the fluid level. A metallic enlargement on the external body of the pump prevents it from travelling below the seating nipple and resilient seal rings on the body of the pump housing, or pump barrel, act to form a leak proof seal between the seating nipple and pump housing, or barrel. The pump is generally driven by a mechanical linkage of metal rods, generally referred to as sucker rods, or valve rods, which extend from the pump to the well surface. The valve rod, or sucker rod, linkage is powered in a reciprocating motion by a conventional mechanical apparatus, usually called a pumping unit located at the well surface.

The conventional pump itself generally includes a housing through which a piston, or plunger, is reciprocated by the sucker rod, or valve rod, linkage. In its simplest form, the conventional pump of the type described often includes a number of ball and seat valves with one such valve in, or above, the piston and another at the inlet port of the housing, or barrel. On the upstroke of the plunger, the ball in the inlet port valve is drawn away from its seat and the ball of the outlet port valve is forced over its seat to draw fluid from below the sealing nipple and into the housing. On the piston's downstroke, the ball in the inlet valve is forced onto its seat and the ball in the piston valve moves away from its seat to allow the piston to move downwardly through the fluid contained in the housing. On the subsequent upstroke, the closing of the piston valve forces the fluid above the piston out of the housing through the outlet ports and into the tubing above the sealing nipple and simultaneously fills the housing below the piston with fluid. Repetition of this cycle eventually fills the tubing string and causes the fluid to flow to the surface.

The previously described pump or some variation thereof is probably the most widely employed in applications where it is desired to drive a sub-surface pump by a surface powered, mechanical linkage. A significant problem in pumps of this type is generally known as "gas locking" as will be hereinafter described. In such conventional pumps, the fluid head pressure in the tubing string is held by the outlet port valve, or ball and seat travelling valve, on the upstroke of the piston and by the inlet port valve, or lower standing valve, on the downstroke thereof. The downstroke of the travelling valve builds up pressure on the fluid between the travelling valve and standing valve which causes the travelling valve to open to allow fluid to pass above the travelling valve, or outlet port valve. However, in a well producing both oil and gas, the chamber between the travelling valve and the standing valve, frequently fills with gas. Due to the compressibility of the gas, the downstroke of the travelling valve may not build up sufficient pressure in the chamber below said valve to equal the pressure of the fluid column above the travelling valve, thus resulting in the travelling valve remaining closed during its downstroke. Thus, the gas between the standing valve and travelling valve merely compresses and expands with each stroke of the pump, producing the operational failure of the pump known as "gas locking." This condition may remedy itself after a short time or may continue indefinitely.

One frequently employed method to cause the travelling valve to open, and thus stop the gas locking condition of the pump, is "banging bottom", or "tagging bottom". In carrying out this procedure, the valve rod guide at the top of the pump is abutted, or "banged," by the sucker rod bushing, as is conventional in the art. The jarring action frequently causes the ball of the ball and seat travelling valve to move off the seat, whereby the gas contained between the standing valve and travelling valve may pass upwardly through the tubing. Many disadvantages are associated with practicing "banging bottom" or "tagging bottom" in order to stop a gas locking condition in a pump. For example, "banging bottom" can cause damage to the pump barrel, tubing, and/or the sucker rods. In this regard, the threads formed on sucker rods, or production tubing, do not typically withstand much lateral stress, or else they will break. Sometimes metal flakes from the sucker rod clutch can fall downwardly and enter the plunger or pump barrel and cause damage to them. Furthermore, sucker rod boxes can wear out holes in the tubing and the pins on the sucker rods can break, which require a fishing operation to retrieve the broken sucker rod and/or it may be necessary to pull all the tubing from the well. Additionally, many wells have problems associated with the buildup of "trash", such as iron sulfite, iron oxide, gyp and/or scale, as well as sand, which builds up in the pump assembly and can cause premature failure of the pump. It is believed that "banging bottom" does help reduce the buildup of such "trash" and sand within the pump assembly, but it has associated therewith many of the previously described disadvantages.

Accordingly, prior to the development of the present invention, there has been no downhole tool for use with a ball and seat travelling valve for a sucker rod actuated fluid pump for raising petroleum fluids through production tubing in completed oil wells which: eliminates "gas locking"; eliminates "banging bottom", or "tagging bottom", to open, or free, the ball and seat travelling valve; reduces the buildup of "trash" and/or sand in the pump; and is economical to manufacture and use, without frequent replacement of valve components. Therefore, the art has sought a downhole tool for use with a ball and seat travelling valve for a sucker rod actuated fluid pump for raising petroleum fluids through production tubing in completed oil wells which: eliminates "gas locking" and "banging bottom" to open the ball and seat travelling valve; reduces the buildup of "trash" and/or sand in the pump; and is economical to manufacture and use.

SUMMARY OF THE INVENTION

In accordance with the present invention, the foregoing advantages have been achieved through the present downhole tool for use with a ball and seat travelling valve associated with a moveable plunger for pumping well fluids. The present invention includes: an upper housing; a lower housing adapted to be associated with the plunger; and means for causing relative movement between the upper and lower housings to impart a bumping force to the plunger, whereby the ball is moved from its seat to permit the passage of well fluids through the travelling valve. A feature of the present invention is that the means for causing relative movement between the upper and lower housings may include a spring-biased housing connector member. Another feature of the present invention is that the spring may be disposed within the upper housing to bias the upper and lower housings toward each other, and the spring engages the housing connector member.

Another feature of the present invention is that there may be provided a means for limiting the amount of compression of the spring to prevent work hardening or breaking of the spring. An additional feature of the present invention is that the means for limiting the amount of compression of the spring may include a stop member disposed on the housing connector member, the stop member being engageable with a portion of the upper housing. A further feature of the present invention is that the upper and lower housings may be generally elongate, tubular-shaped members, and the spring-biased housing connector may be an elongate member having upper and lower ends, the lower end being fixedly secured to the lower housing and the upper end is slidably received within the upper housing.

The downhole tool of the present invention, when compared with the previously proposed method of "banging bottom" for relieving gas locking, has the advantages of: eliminating gas locking, without damaging components of the pump; is believed to reduce the buildup of "trash" and/or sand in the pump; and being economical to manufacture and use.

While the invention will be described in connection with the preferred embodiment, it will be understood that it is not intended to limit the invention to that embodiment. On the contrary, it is intented to cover all alternatives, modifications, and equivalents as may be included within the spirit and scope of the invention as defined by the appended claims.

DETAILED DESCRIPTION OF THE INVENTION

Figure 1:
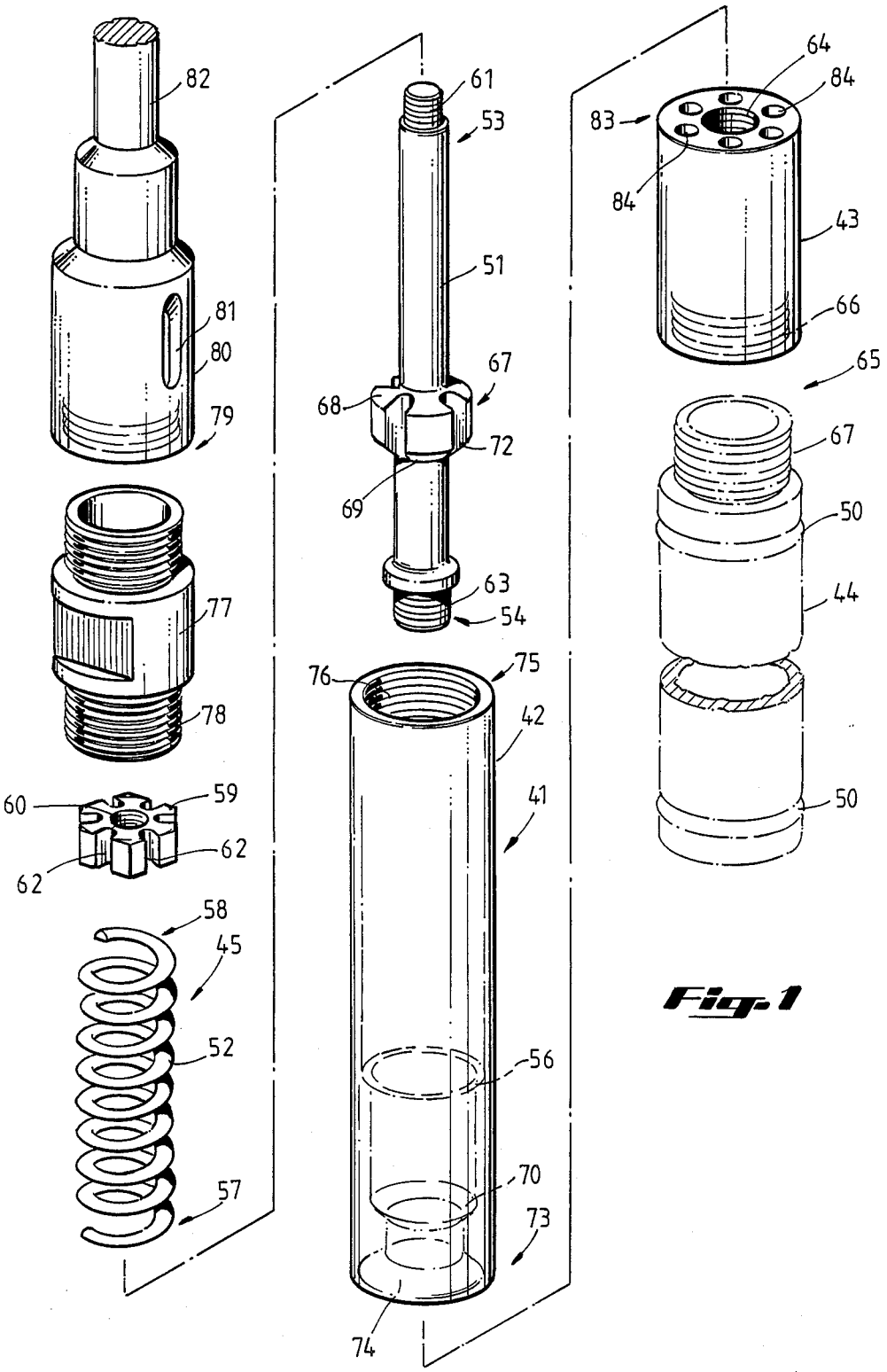
FIG. 1 is an exploded view of a downhole tool in accordance with the present invention.
Figure 2:
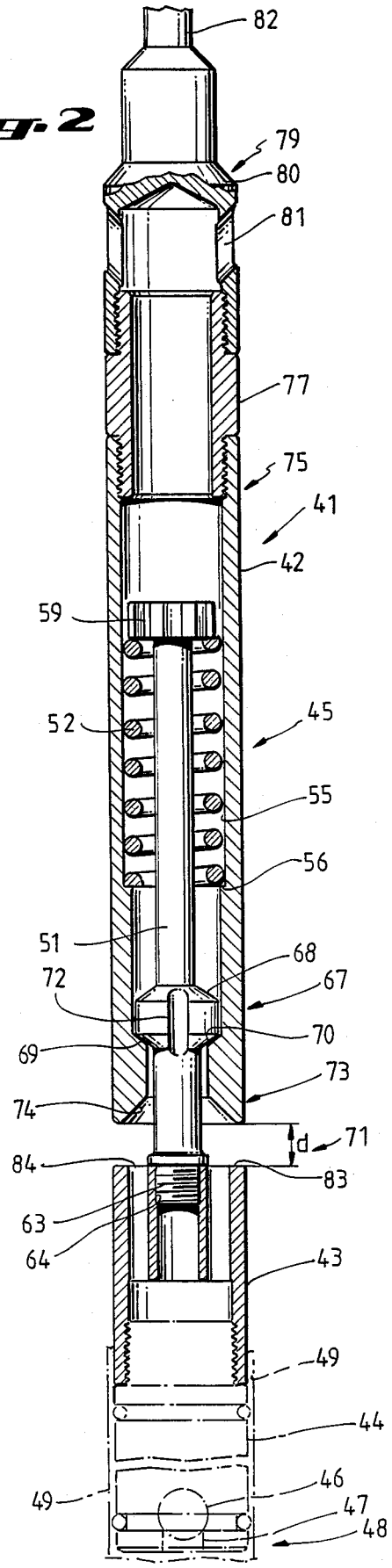
FIG. 2 is a partial cross-sectional view along the longitudinal axis of a downhole tool of the present invention, in the upstroke position.

In FIGS. 1 and 2, a downhole tool 41 in accordance with the present invention, is shown to generally comprise: an upper housing 42; a lower housing 43 adapted to be associated with a plunger 44; and means for causing relative movement 45 between the upper and lower housings 42, 43 to impart a bumping force to the plunger 44, whereby a ball 46 is moved from its seat 47 to permit the passage of well fluids (not shown) through a travelling valve 48, comprised of ball 46 and seat 47. Downhole tool 41 is intended for use within a conventional pump barrel 49 (shown in phantom lines in FIG. 2, which pump barrel 49 would be disposed within conventional production tubing (not shown) as is well known in the art. As is conventional in the art, plunger 44 is sealingly received within pump barrel 49, and may include conventional O-ring seals 50. As is conventional in the art, a lower ball and seat valve, or standing valve (not shown) is disposed within pump barrel 49 below plunger 44. It should be noted that for drawing clarity, ball 46 and seat 47 are not shown in FIG. 1.

Still with reference to FIGS. 1 and 2, the means for causing relative movement 45 between the upper and lower housings 42, 43 may include a spring-biased housing connector member 51. A spring 52 is disposed within the upper housing 42 and engages the housing connector member 51, as will be hereinafter described in greater detail, to bias the upper and lower housings 42, 43 toward each other. Upper and lower housings 42, 43 are generally elongate, tubular-shaped members and the spring-biased housing connector 51 may be an elongate member having upper and lower ends 53, 54, the lower end 54 being fixedly secured to the lower housing 43 and the upper end 53 is slidably received within the upper housing 42, as will be hereinafter described in greater detail. The interior surface 55 of upper housing 42 is preferably provided with an annular ledge surface, as at 56, upon which the lower end 57 of spring 52 rests. The upper end 58 of spring 52 abuts against a cap member 59 which is secured to the upper end 53 of housing connector member 51, as by threads 60 which mate with threads 61 formed at the upper end 53 of housing connector member 51. Cap member 59 preferably includes a plurality of fluid passageways 62 formed therein which permit well fluids to pass past cap member 59 upwardly into the production tubing (not shown). The lower end 54 of housing connector member 51 likewise has threads 63 formed thereon which mate with the internal threads 64 formed in lower housing 43. Lower housing 43 preferably includes a means for attaching 65 the lower housing 43 to plunger 44. Attachment means 65 may preferably comprise a plurality of internal threads 66 formed on the lower end of lower housing 43, which threads 66 mate with a plurality of external threads 67 formed on the upper end of plunger 44. In this manner, lower housing 43 is adapted to be associated with the plunger 44. It should be understood that an intermediate connector member (not shown) could be used to associate lower housing 43 with the plunger 44, provided the desired bumping force may be transmitted to plunger 44, as well as permitting the flow of well fluids through plunger 44 and lower housing 43. In this regard, lower housing 43 is preferably provided with a plurality of fluid flow passageways 84 extending through lower housing 43.

As seen in FIG. 2, the downhole tool 41 of the present invention may preferably be provided wih a means for limiting 67 the amount of compression of the spring 52 to prevent work hardening or breaking of the spring 52. Preferably, the compression limiting means 67 comprises a stop member 68 disposed upon the housing connector member 51, the lower surface 69 of stop member 68 being formed to abut an annular, internal land surface 70 formed on the internal surface 55 of upper housing 42. As will be hereinafter described in greater detail, FIG. 2 illustrates downhole tool 41 of the present invention in the configuration it would assume during the upstroke, wherein spring 52 is compressed, and upper and lower housings 42, 43 are separated from one another by a distance "d" as shown by arrow 71. Thus, it is seen that the abutment of the lower surface 69 of stop member 68 with land surface 70 prevents spring 52 from being completely compressed. It is believed that by limiting the amount of compression of spring 52, the likelihood of spring 52 becoming work hardened, and/or breaking, after many cycles of compression and expansion is decreased. Stop member 68 is also provided with a plurality of fluid flow passageways 72 to permit well fluids to pass thereby, during operation of downhole tool 41. Preferably, the lower end 73 of upper housing 42 is provided with an upperwardly tapering annular surface 74 to permit well fluids to pass from fluid flow passageways 68 of lower housing 43 upwardly through upper housing 42 when upper and lower housings 42, 43 are in an abutting relationship as shown in FIG. 3.

With further reference to FIGS. 1 and 2, the upper end 75 of upper housing 42 is provided with internal threads 76 for engagement with a tubular pin connector member 77 having matching threads 78 formed thereon. Pin connector 77 may be threadedly received by a conventional valve rod connector member 79 which may be an open plunger cage 80 or a conventional hollow pull tube (not shown). Valve rod connector member 79 is preferably provided with a plurality of fluid ports 81 which permit well fluids to pass outwardly of valve rod connector member 79 into the production tubing (not shown). A conventional valve rod 82 may be threadedly received within valve rod connector member 79, as is well known in the art.

Figure 3:
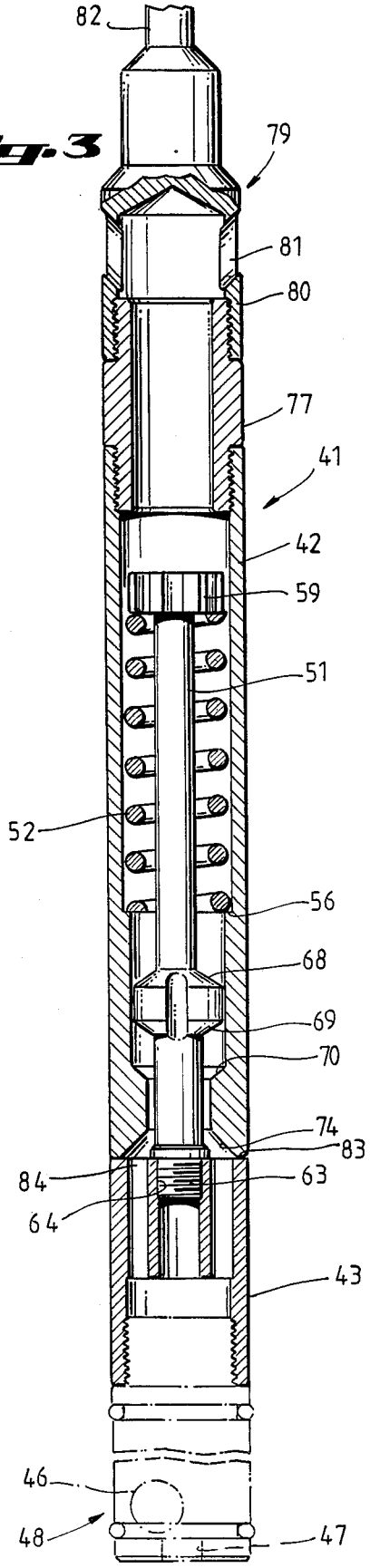
FIG. 3 is a partial cross-sectional view of a downhole tool of the present invention, in the downstroke position.

With reference now to FIGS. 2 and 3, the operation of the downhole tool 41 of the present invention will be described in greater detail. In FIG. 2, the downhole tool 41 and plunger 44 are shown in the upstroke position. As previously described with regard to a conventional fluid pump having a ball 46 and seat 47 for travelling valve 48 and a lower standing valve (not shown), during the upstroke ball 46 is seated upon seat 47 and the lower standing valve is open, whereby well fluids can be drawn into the pump barrel 49. As downhole tool 41 and plunger 44 are raised by the valve rod 82 in a conventional manner, the hydrostatic load of the well fluids, or the weight of the fluid in the tubing, above the downhole tool 41 and plunger 44 and the frictional drag of plunger 44 within pump barrel 49 will cause the spring 52 of downhole tool 41 to be compressed, and upper housing 42 will separate from the lower housing 43 as shown at 71 in FIG. 2. As previously described, stop member 68 limits the amount of compression of spring 52. Thus, the means for causing relative movement 45 between the upper and lower housings 42, 43, or the compression of spring 52, is activated, or "cocked", whereby a bumping force may be later imparted to the plunger 44 during the downstroke of downhole tool 41 and plunger 44.

With reference now to FIG. 3, downhole tool 41 and plunger 44 are illustrated in their downstroke position, just as the desired bumping force has been applied to the plunger 44 by the relative movement between upper and lower housings 42, 43 of downhole tool 41, whereby the lower end 73 of upper housing 42 abuts, or "bumps" against the upper end 83 of lower housing 43. As the bumping force is imparted to plunger 44, ball 46 is jarred and moves off its seat 47, in order to permit well fluids to pass upwardly through seat 47 and through downhole tool 41 and upwardly through pin connector 77 and sucker rod connector member 79, as previously described. As seen in FIG. 3, as downhole tool 41 moves through its downstroke, spring 52 extends longitudinally, and housing connector member 51 slides within upper housing 42 as shown in FIG. 3. It is believed that as plunger 44 moves through pump barrel 49 and acts against the well fluids disposed below plunger 44 and above the lower standing valve, and because of the frictional forces between plunger 44 and pump barrel 49, the velocity of plunger 44 is decreased, whereby the upper housing 42 moves downwardly until it "catches up" with the lower housing 43 and plunger 44 whereby the desired bumping force is imparted to plunger 44. It has been found that when downhole tool 41 is utilized in a well wherein the gas-locking condition is only occasionally encountered, whereby the well fluids being pumped are predominantly liquids, the desired bumping force is imparted shortly after the downstroke movement of the downhole tool 41 begins. When gas-locking conditions occur, wherein the well fluids disposed between the plunger 44 and the lower standing valve have a high concentration of gas, the desired bumping force is imparted toward the very end of the downstroke movement of downhole tool 41.

It is further believed that the desired bumping force imparted to the plunger 44 causes a reduction of buildup of "trash" such as iron sulfide, iron oxide, gyp, and scale, as well as sand, in the pump components, whereby the useful life of the pump components is extended. The desired cyclic bumping force is believed to apparently knock loose the trash and/or sand within the pump components, whereby they may pass upwardly through the production tubing, without building up on the pump components.

It is to be understood that the invention is not limited to the exact details of construction, operation, exact materials or embodiments shown and described, its obvious modifications and equivalents will be apparent to one skilled in the art. For example, the spring could be disposed within the lower housing, and the housing connector member could slide within the lower housing. Furthermore, a hydraulic piston and cylinder arrangement could be utilized to provide the biasing force to the housing connector member. Accordingly, the invention is therefore to be limited only by the scope of the appended claims.

I claim:

1. A downhole tool for use with a ball and seat travelling valve associated with a movable plunger, having upper and lower ends, for pumping well fluids, comprising:

an upper housing;

a lower housing adapted to be associated with the upper end of the plunger; and means for causing relative movement between the upper and lower housings and abutment of the upper housing against the lower housing to impart a bumping force to the plunger during the downward movement of the plunger, whereby the ball is moved from its seat to permit the passage of well fluids through the travelling valve.

2. The downhole tool of claim 1, wherein the means for causing relative movement between the upper and lower housings includes a spring-biased housing connector member.

3. The downhole tool of claim 2, wherein a spring is disposed within the upper housing to bias the upper and lower housings toward each other, and the spring engages the housing connector member.

4. The downhole tool of claim 3, including means for limiting the amount of compression of the spring to prevent work hardening or breaking of the spring.

5. The downhole tool of claim 4, wherein the means for limiting the amount of compression of the spring includes a stop member disposed on the housing connector member, the stop member being engageable with a portion of the upper housing.

6. The downhole tool of claim 1, including means for attaching the lower housing to the plunger.

7. The downhole tool of claim 2, wherein the upper and lower housings are generally elongate, tubular-shaped members, and the spring-biased housing connector is an elongate member having upper and lower ends, the lower end being fixedly secured to the lower housing and the upper end is slidably received within the upper housing.

* * * * *